US005626046A

United States Patent [19]

Main

[11] Patent Number: 5,626,046

[45] **Date of Patent: *May 6, 1997**

[54] LIGHTWEIGHT RAM FOR BODYMAKER

[75] Inventor: Ralph Main, San Pedro, Calif.

[73] Assignee: Sequa Corporation, Hackensack, N.J.

[ * ] Notice: The portion of the term of this patent subsequent to Nov. 25, 2011, has been disclaimed.

[21] Appl. No.: 457,994

[22] Filed: Jun. 1, 1995

Related U.S. Application Data

[63] Continuation-in-part of Ser. No. 212,036, Mar. 10, 1994, abandoned.

[51] Int. Cl.[6] ..... B21C 25/02

[52] U.S. Cl. ..... 72/273; 72/347; 72/349; 72/479

[58] Field of Search ..... 72/347, 349, 479, 72/273; 29/447; 228/135; 219/121.13, 121.14, 59.1, 72

[56] References Cited

U.S. PATENT DOCUMENTS

| | | | |
|---|---|---|---|
| 3,704,619 | 12/1972 | Paramonoff | 72/349 |
| 3,735,629 | 5/1973 | Paramonoff | 72/349 |
| 3,780,412 | 12/1973 | Millard | 29/159.2 |
| 4,036,047 | 7/1977 | Miller | 72/347 |
| 4,133,094 | 1/1979 | Stafford | 29/447 |
| 4,148,208 | 4/1979 | Maeder | 72/342 |
| 4,409,462 | 10/1983 | Jahnke | 219/121 ED |
| 4,530,228 | 7/1985 | Snyder et al. | 72/349 |
| 4,614,104 | 9/1986 | Straw | 72/347 |
| 4,639,571 | 1/1987 | Lewandowski et al. | 219/121 EC |
| 5,208,435 | 5/1993 | Main et al. | 219/121.13 |
| 5,465,601 | 11/1995 | Jowitt et al. | 72/347 |

*Primary Examiner*—Lowell A. Larson
*Assistant Examiner*—Rodney Butler
*Attorney, Agent, or Firm*—Mitchell D. Bittman

[57] ABSTRACT

A ram that is utilized in high speed apparatus for forming elongated one piece metal can bodies from shallow cups is constructed by metallurgically bonding either a nose piece to a body or a tail piece to a body, the body constructed from a single integral piece having an elongated thin walled tube section with either a tail piece section or a nose piece section for connection to a drive means.

22 Claims, 4 Drawing Sheets

LIGHTWEIGHT RAM FOR BODYMAKER

RELATED APPLICATIONS

This application is a continuation-in-part of application Ser. No. 08/212,036, filed Mar. 10, 1994, now abandoned.

BACKGROUND OF THE INVENTION

The invention relates to the construction of a ram that is utilized in high speed apparatus for forming elongated one piece metal can bodies from relatively shallow cups, and more specifically relates to an improved lightweight ram with increased integrity against stresses produced during the operation of the bodymaker.

The main section or body of a so-called two piece metal container or can of the type very often used for beer/beverages includes an elongated cylindrical sidewall, an integral bottom and an open top. Such bodies are often formed in drawing and ironing machines of the type described in U.S. Pat. No. 3,704,619 issued Dec. 5, 1972 to E. Paramonoff for Redraw Blankholder Positioning Mechanism for Cup-shaped Article Formers such as Metallic Can Body Formers and the Like, U.S. Pat. No. 3,735,629 issued May 29, 1973 to E. Paramonoff entitled Apparatus for Forming One Piece Metallic Can Bodies, and U.S. Pat. No. 4,530,228 issued Jul. 23, 1985 to W. Snyder and D. Dettmer for Apparatus for Producing Seamless Container Bodies. The apparatus described in the aforesaid patents produce can bodies from blanks in the form of relatively shallow cups, by having a reciprocated ram drive each cup through a die pack which is a series of ringlike die elements having openings that are graduated. Each blank passes through the largest opening first, and each subsequent opening that the blank is driven through is slightly smaller than the preceding opening through which the blank has been driven.

A replaceable punch mounted to the ram at the front thereof engages each cup to drive it through the die pack. The rear end of the ram is connected to the drive means that reciprocates the ram along its horizontally positioned longitudinal axis through a forward working stroke followed by a rearward return stroke.

Conventionally, rams are manufactured from a single piece of barstock. This imposes severe limitations on readily machining the interior of the hollow elongated main center section of the ram. This problem arises because the axial passages at both ends of the ram are limited in diameter, being considerably less than the center section diameter that will still enable the center section to provide the required mechanical strength (without having excessive wall thickness). Thus, in the prior art, wall thickness of the main center section was unusually considerably greater than necessary to meet strength requirements, so that the rams were unnecessarily heavy.

In U.S. Pat. No. 5,208,435 a ram is provided constructed as a weldment in which there is an elongated tube, a tail piece metallurgically bonded to one end of the tube and a nose piece metallurgically bonded to the other end of the tube. While effective, this ram could experience excessive stress levels in the weld zones with the effects of these stresses being magnified when the welds have imperfections.

SUMMARY OF THE INVENTION

A lightweight ram is provided comprising a nose piece, a body and a tail piece, in which the ram is constructed of two elements metallurgically bonded together to form a unitary structure. To produce a relatively lightweight ram the instant invention provides a unitary structure that is constructed by metallurgically bonding a nose piece to a body, the body constructed from a single integral piece having an elongated thin walled tube section with a front end and a tail piece section adapted for connection to a drive means that reciprocates the ram along its longitudinal axis. Preferably the front end of the body and the nose piece have overlapping portions and are assembled by shrink fitting together. In an alternate embodiment the unitary structure is constructed by metallurgically bonding a tail piece to a body, the body constructed from a single integral piece having an elongated thin wall tube section with a back end and a nose piece, with the back end of the body and the tail piece preferably having overlapping portions and are assembled by shrink fitting together. Bonding is carried out by welding which achieves attachment strength that is for all practical purposes equal to the strength found in a ram manufactured from a single piece of barstock. Preferably, tube wall thickness is selected so that is does not exceed substantially that thickness required to provide sufficient strength for the job that the ram is required to perform thereby minimizing weight. The reduction in weight achieved by welding two pieces together to form the ram is significant and results in increased can production because an increase in the cyclic rate of the machine is permitted.

Accordingly, the primary object of the instant invention is to provide a relatively lightweight ram for a can body maker.

Another object is to provide a ram or this type that is constructed of two elements metallurgically bonded together to form a unitary structure.

Another object is to provide a ram of this type in which the two elements are also shrink fit together.

Another object is to reduce the level of bending stress at the weld joint, supported by the overlap shrink fit area.

Still another object is to provide a ram of this type that is manufactured by welding techniques.

A further object is to provide a ram of this type in which the main elongated center section thereof has a length to wall thickness ratio greater than one hundred.

A still further object is to provide a ram of this type which permits increased machine speed.

These objects as well as other objects of this invention shall become readily apparent after reading the following description of the accompanying drawings in which:

Figure 1:
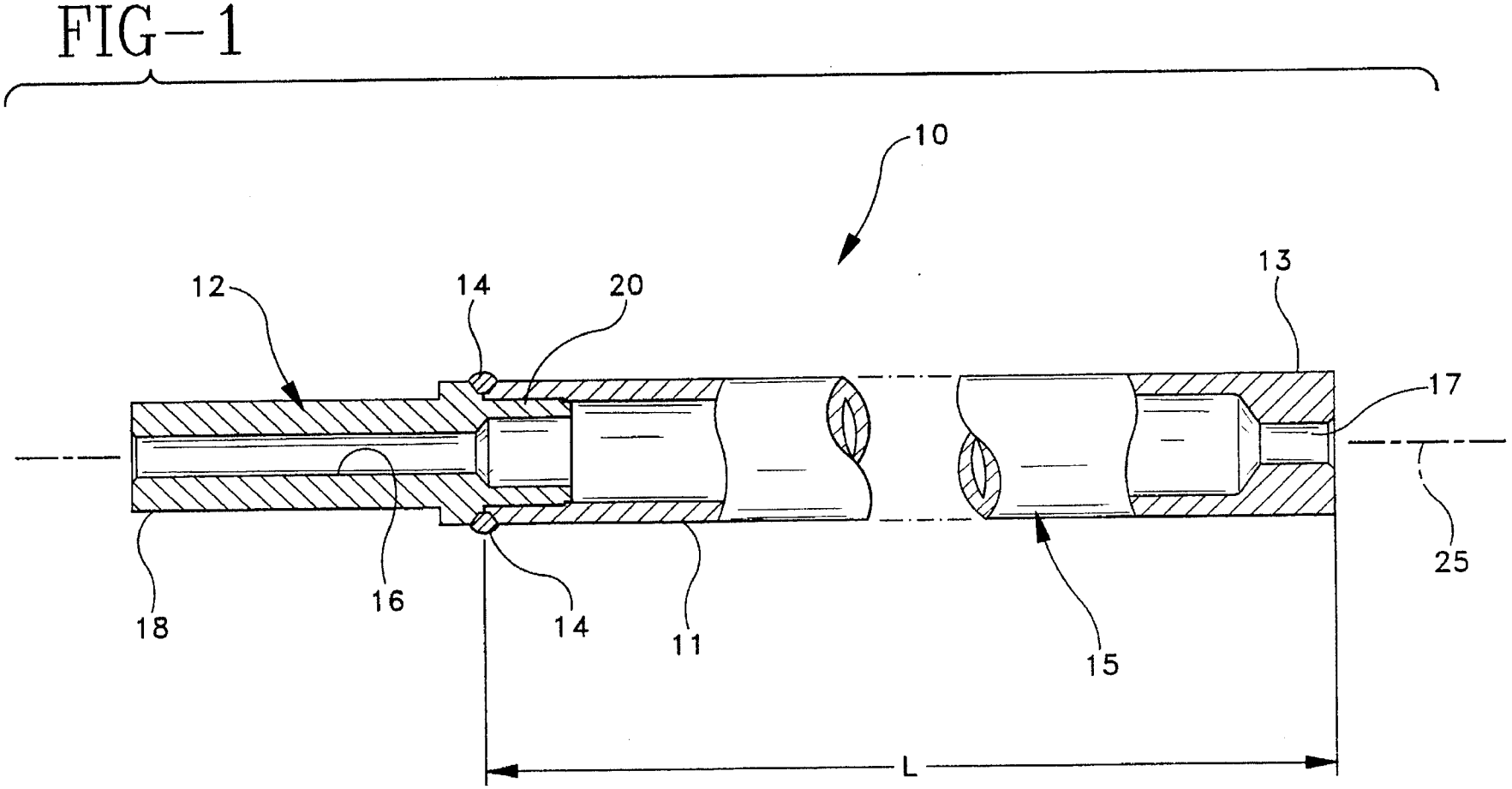
FIG. 1 is a partially sectioned side elevation of a lightweight ram constructed in accordance with teachings of the instant invention.
Figure 2:
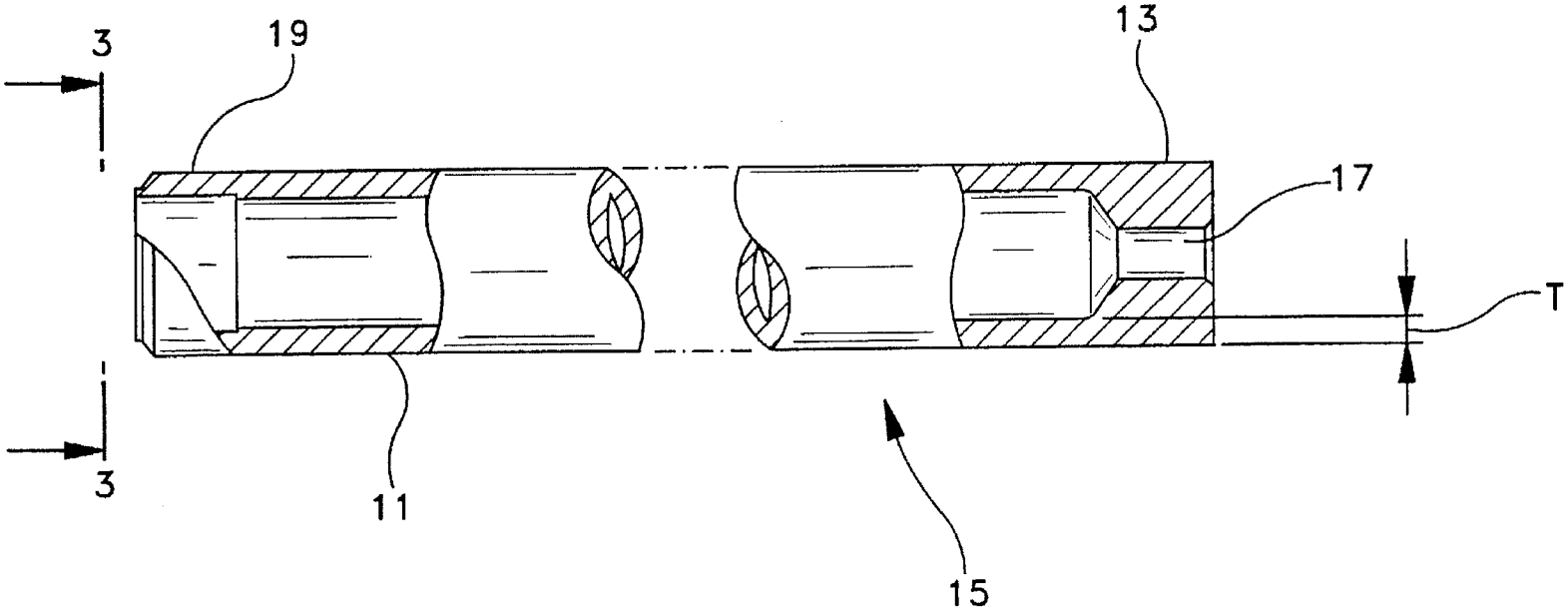
FIG. 2 is a partially sectioned side elevation of the body of the lightweight ram.
Figure 3:
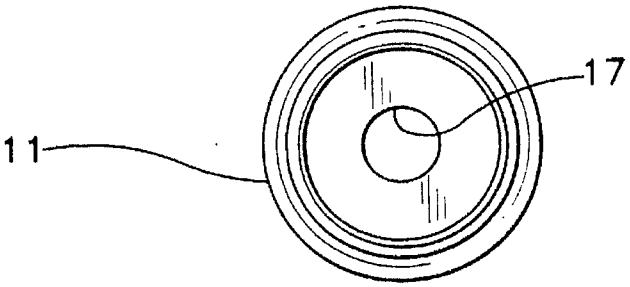
FIG. 3 is an end view of the body of the lightweight ram looking in the direction of arrows 3—3 of FIG. 2.
Figure 4:
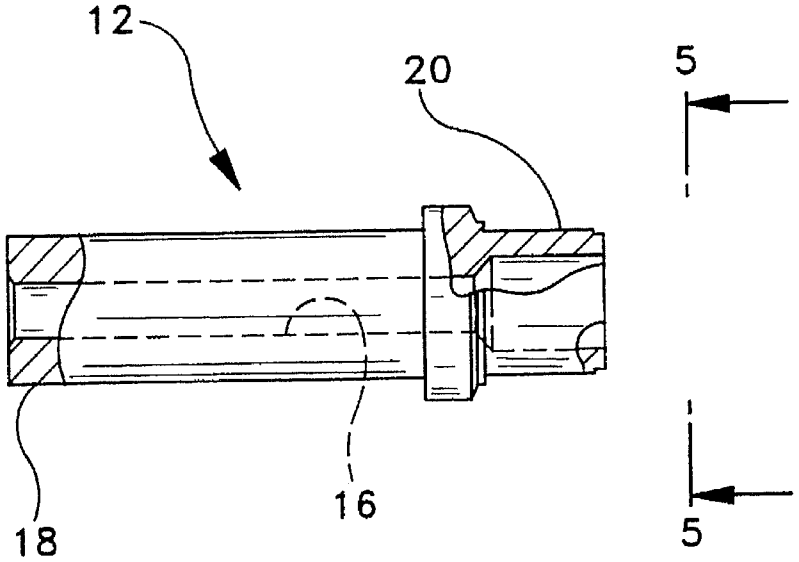
FIG. 4 is a partially sectioned side elevation of the nose piece of the lightweight ram.
Figure 5:
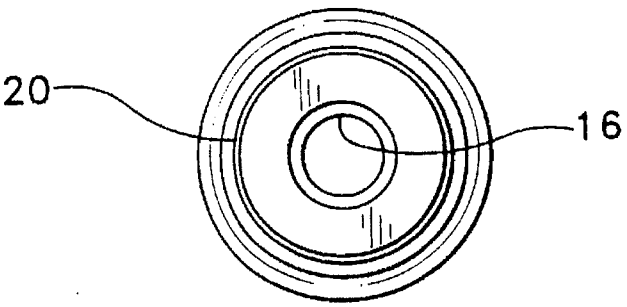
FIG. 5 is an end view of the nose piece of the lightweight ram looking in the direction of arrows 5—5 of FIG. 4.

Now referring to the Figures.

DETAILED DESCRIPTION OF THE INVENTION

As shown in FIGS. 1–5, ram 10 is constructed by utilizing weld 14 to metallurgically bond nose piece 12 to the front end 19 of thin walled tubular center section 11 of body 15. Body 15 is constructed of a single integral piece (i.e. single piece construction) having an elongated thin-walled tube section 11 with a front end 19 and a tail piece section 13. The body is preferably constructed by drilling out material from a solid bar or tube to form the thin walled tube section 11 and integral tail piece section 13. Advantageously by construction of body 15 having an integral tube section 11 and tail piece section 13, a weld or joint between these two sections is eliminated at a point on the ram 10 where increased stresses are exhibited during the bodymaker operation, thus increasing the structural integrity of the ram as there is no joint to break.

Figure 6:
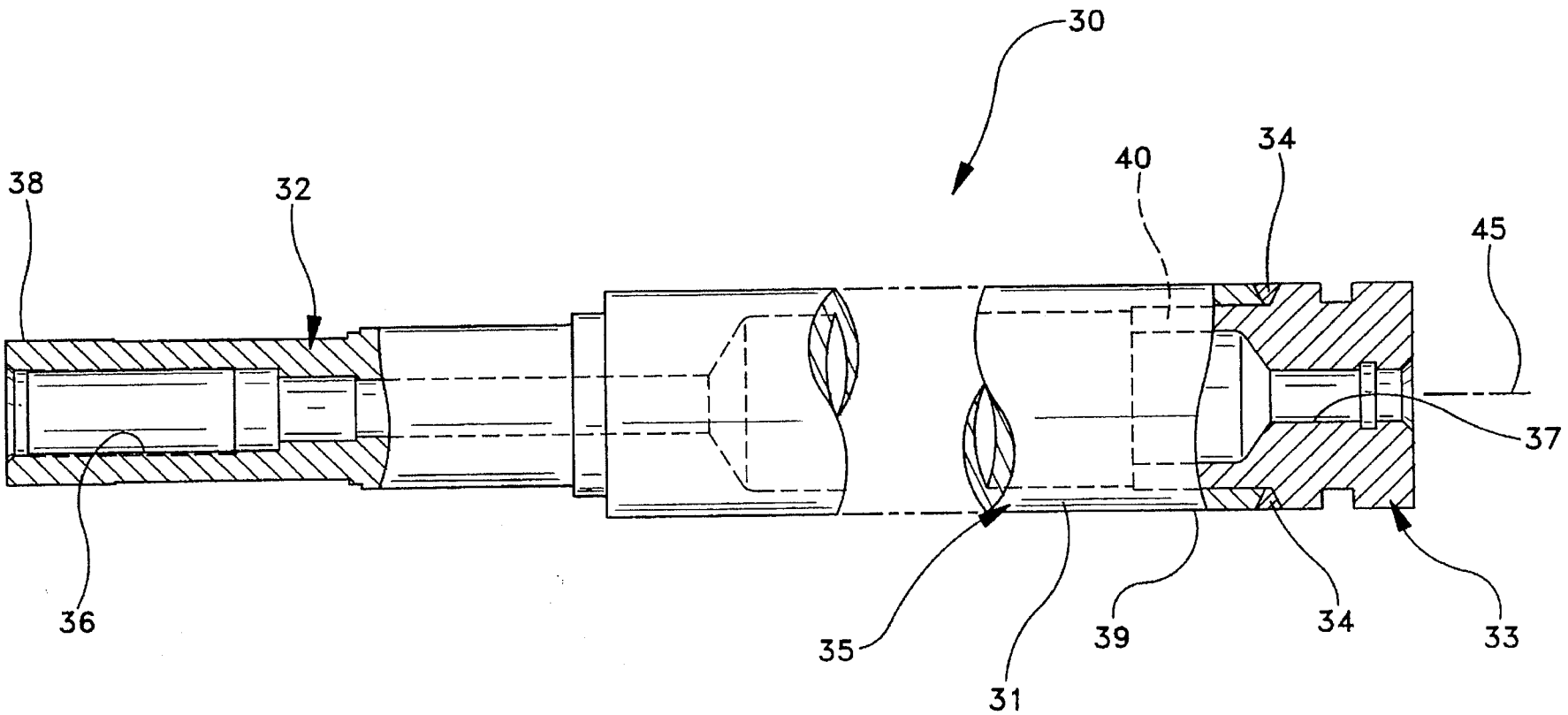
FIG. 6 is a partially sectioned side view of an alternate embodiment of a lightweight ram constructed in accordance with the teachings of this invention.

In FIG. 6 an alternate embodiment to this invention is shown in which ram 30 is constructed by utilizing weld 34 to metallurgically bond tail piece section 33 to the back end 39 of thin walled tubular section 31 of body 35. Body 35 is constructed of a single integral piece (i.e. single piece construction) having an elongated thin walled tube section 31 with a back end 39 and a nose piece section 32. The body is preferably constructed by drilling out material from a solid bar or tube to form the thin walled section 31 and an integral nose piece section 32. By construction of a body 35 having an integral tube section 31 and nose piece section 32, a weld or joint between these two sections is eliminated at a point on the ram where increased stresses are exhibited during the bodymaker operation. A further advantage of this embodiment is that if a break at the weld does occur, less damage is likely when the break occurs at the tail piece verses at the nose piece.

Typically, main section 11 or 31 has a length L that is approximately 42 inches or less and is at least one hundred times greater than the wall thickness T of tube section 11 or 31. In a practical construction, tube section 11 or 31 has an outer diameter of approximately 2.5 inches and an inner diameter of approximately 2 inches. This results in a wall thickness of ¼ inch which is a reduction of as much as 64% of the ⅝ inch to 11/16 inch wall thickness of the central section in prior art rams that are machined from a single piece of bar stock. When the wall thickness of tube section 11 or 31 is ⅛ inch, this an 82% reduction from the 11/16 inch wall thickness found in the prior art. Preferably the tube section 11 or 31 has an axial passage that is of a diameter which is greater than 75% of the outer diameter of the tube section 11 or 31.

Suitable axial lengths for nose piece 12 or 32 and tail piece section 13 or 33 of the body are approximately 6.6 inches and 1.7 inches, respectively. The diameters of the axial passages 16 or 36 and 17 or 37 for the respective nose and tail pieces are approximately ¾ of an inch. The diameter of the axial passage of the tube section 11 or 31 is preferably at least two times the diameter of the axial passages for both the nose piece 12 or 32 and the tail piece section 13 or 33.

Nose piece 12 or 32 is adapted to mount and operatively position a punch nose and sleeve (not shown) with the latter surrounding and being closely fitted to cylindrical outer surface portion 18 or 38 of nose piece 12 or 32. Punch elements can be secured in place by retainer screw having external threads that mate with internal threads at the front of passage 16 or 36. A punch nose can be secured to the nose piece 12 or 32 depicted in FIGS. 1 or 6 by a punch nose retainer screw.

Tail piece section 13 or 33 is adapted to be connected to a drive means (not shown) for reciprocating ram 10 or 30 along its longitudinal axis 25 or 45. Suitable drive means for ram 10 or 30 as well as other details of can body forming apparatus are described in the aforesaid U.S. Pat. Nos. 3,704,619, 3,735,629 and/or 4,530,228. The teachings of these three patents are incorporated herein by reference.

Welding that forms weld 14 or 34 and metallurgical bonds elements 12 and 15 shown in FIG. 1 or 33 and 35 shown in FIG. 6 achieves attachment strength that is, for practical purposes, equal to having a unit of single piece construction. Preferably, in order to reduce the level of stress at weld 14 or 34, the front end 19 of the tube section 11 and the nose piece 12 as shown in FIG. 1 or the back end 39 of the tube section 31 and the tail piece section 33 as shown in FIG. 6 are constructed so that a portion of one will overlap and closely fit over a portion of the other in order that they may be shrink fit together, i.e. they are assembled by heating the overlapping portion of front end 19 or back end 39 to expand it and snugly fit it onto the underlying portion 20 or 40. The overlapping portions are at least ¾ inches preferably 1 ¼ to 1½ inches to achieve a good shrink fit. Suitable shrink fitting is carried out by heating the body 15 or 35 to 400°–450° F. followed by inserting the underlying portion 20 or 40 of the nose piece 12 (FIG. 1) or the tail piece 33 (FIG. 6) into the overlapping portion of the front end 19 of the body 15 or back end 39 of body 35. Shrink fitting the nose piece 12 and body 15 or tail piece 33 and body 35 together helps keep the stresses away from the weld during the bodymaker operation, i.e. by distributing all annular stress levels caused by bending to the weld joint area, thus increasing the integrity of the ram 10 or 30. The weld 14 or 34 can be formed by a conventional gas-shielded tig-arc weld. Test specimens were pull tested at 100,000 lbs. tension without failure at the weld joint.

Because the wall of tubular main section 11 or 31 is essentially no thicker than required, ram 10 or 30 is relatively lightweight so that inertia forces are reduced. Comparing ram 10 or 30 with conventionally drilled rams of one piece construction, reductions in weight of up to about 45% are obtainable. Because of this foundation vibration is lessened and machine wear slows down considerably, thereby permitting machine speed to be increased without harmful effects. Ram 10 or 30 is also interchangeable with rams of conventional one piece construction.

Elements 12 and 15 or 33 and 35 are constructed of alloy steel, with 9310 VAR being suitable for this purpose. After the elements are axially aligned, shrink fit and then bonded together by welding, the assembly is subjected to stress relieving, carburizing and finish machining operations. As an alternative, elements 12 and 15 or 33 and 35 before they are assembled, and after applying weld 14 or 34, are stress relieved only at localized areas adjacent the weld 14 or 34.

Although the present invention has been described in relation to particular embodiments thereof, many other variations and modifications and. other uses will become apparent to those skilled in the art. It is preferred, therefore, that the present invention be limited not by the specific disclosure herein, but only by the appended claims.

What is claimed is:

1. A lightweight ram for high speed apparatus that produces relatively elongated can bodies by driving relatively shallow cups through a ring type die means, said ram including:

a nose piece constructed to mount and operatively position a punch on said ram;

a body constructed from a single integral piece having an elongated thin-walled tube section with a front end and tail piece section adapted for connection to a drive means that reciprocates the ram along its longitudinal axis;

said nose piece, said tube section and said tail piece section being in axial alignment, with said tube section interposed between said nose piece and said tail piece section;

a metallurgical bond fixedly securing said nose piece to said tube section at said front end and extending forward thereof.

2. Ram of claim 1 wherein the body is constructed by drilling out material to form the thin-walled tube section and tail piece section.

3. Ram as defined by claim 1 in which a weld metallurgically bonds the tube section to the nose piece.

4. Ram as defined by claim 1 in which the body and the nose piece are constructed of alloy steel.

5. Ram as defined by claim 1 in which the tube has a length that is greater than one hundred times its wall thickness.

6. Ram of claim 2 wherein the front end of the tube section of the body and the nose piece are constructed so that a portion of one will overlap a portion of the other when fixedly securing the nose piece to the front end of said tube section.

7. Ram of claim 6 wherein the portion of overlap is at least ¾ inch wide.

8. Ram of claim 7 wherein the front end and the nose piece are first assembled by heating the overlapping portion to expand it and shrink fit the front end and nose piece together.

9. Ram of claim 8 wherein the portion of the front end overlaps the portion of the nose piece.

10. Ram as defined by claim 5 wherein there are aligned axial passages through the nose piece, the tube section and the tail piece section, with the axial passage of the tube section having a diameter of at least two times the diameter of the axial passages for both the nose piece and the tail piece section.

11. Ram as defined by claim 5 wherein the tube section has an axial passage that is of a diameter which is greater than 75% of the outer diameter of the tube section.

12. A lightweight ram for high speed apparatus that produces relatively elongated can bodies by driving relatively shallow cups through a ring type die means, said ram including:

a nose piece, a body and a tail piece, in which the ram consists of two elements which are metallurgically bonded together to form a unitary structure;

the nose piece constructed to mount and operatively position a punch on said ram; the body having an elongated thin-walled tub section; the tail piece constructed for connection to a drive means that reciprocates the ram along its longitudinal axis; and said nose piece, said body and said tail piece being in axial alignment, with said body interposed between said nose piece and said tail piece.

13. Ram of claim 12 wherein the body is constructed by drilling out material to form the thin-walled tube section.

14. Ram as defined by claim 12 in which a weld metallurgically bonds the two elements together.

15. Ram as defined by claim 12 in which the body and the tail piece are constructed of alloy steel.

16. Ram as defined by claim 12 in which the tube has a length that is greater than one hundred times its wall thickness.

17. Ram of claim 13 wherein the two elements are constructed so that a portion of one will overlap a portion of the other when fixedly securing to said tube section of the body.

18. Ram of claim 17 wherein the portion of overlap is at least ¾ inch wide.

19. Ram of claim 18 wherein the two elements are first assembled by heating the overlapping portion to expand it and shrink fit together.

20. Ram of claim 16 wherein the tube section of the body includes the overlapping portion.

21. Ram as defined by claim 16 wherein there are aligned axial passages through the tail piece, the tube section and the nose piece section, with the axial passage of the tube section having a diameter of at least two times the diameter of the axial passages for both the tail piece and the nose piece.

22. Ram as defined by claim 16 wherein the tube section has an axial passage that is of a diameter which is greater than 75% of the outer diameter of the tube section.

* * * * *